US012416466B2

(12) United States Patent
Chia

(10) Patent No.: US 12,416,466 B2
(45) Date of Patent: Sep. 16, 2025

(54) LAUNCHER OF SHORT PROJECTILES WITH DETACHABLE BARREL

(71) Applicant: EASEBON SERVICES LIMITED, Kwun Tong (HK)

(72) Inventor: Francis See Chong Chia, Kowloon (HK)

(73) Assignee: EASEBON SERVICES LIMITED, Kwun Tong (HK)

( * ) Notice: Subject to any disclaimer, the term of this patent is extended or adjusted under 35 U.S.C. 154(b) by 100 days.

(21) Appl. No.: 18/278,280

(22) PCT Filed: Feb. 17, 2022

(86) PCT No.: PCT/SG2022/050073

§ 371 (c)(1),
(2) Date: Aug. 22, 2023

(87) PCT Pub. No.: WO2022/177506

PCT Pub. Date: Aug. 25, 2022

(65) Prior Publication Data

US 2024/0125575 A1 Apr. 18, 2024

Related U.S. Application Data

(60) Provisional application No. 63/151,853, filed on Feb. 22, 2021.

(51) Int. Cl.
*F41B 11/89* (2013.01)
*F41B 11/54* (2013.01)
(Continued)

(52) U.S. Cl.
CPC ..... *F41B 11/643* (2013.01); *F41B 11/54* (2013.01); *F41B 11/73* (2013.01); *F41B 11/89* (2013.01)

(58) Field of Classification Search
CPC ..... F41B 11/54; F41B 11/73; F41B 11/642; F41B 11/643; F41B 11/646; F41B 11/89
(Continued)

(56) References Cited

U.S. PATENT DOCUMENTS 4,848,307 A * 7/1989 Tsao ..... F41B 11/54 124/66
5,186,156 A * 2/1993 Clayton ..... F41B 11/54 124/66
(Continued)

FOREIGN PATENT DOCUMENTS

CN 203642796 U 6/2014
CN 110869691 A 3/2020
(Continued)

OTHER PUBLICATIONS

International Search Report issued in Application No. PCT/SG2022/050073, mailed May 23, 2022.
(Continued)

*Primary Examiner* — Alexander R Niconovich
(74) *Attorney, Agent, or Firm* — Amster, Rothstein & Ebenstein LLP

(57) ABSTRACT

A toy projectile launcher having a housing, a projectile container, a cocking slide, an air piston assembly, a barrel interface section, and a detachable launch barrel is disclosed. The projectile container is adapted to hold projectiles, such as foam darts. The cocking slide can be moved for-ward and backward. When the cocking slide is moved backward the air piston barrel moves backward, and a projectile is moved in front of the air piston assembly. When the cocking slide is moved forward, the projectile is pushed into the barrel interface section by an air nozzle disposed on the front of the air piston assembly. A first airtight seal is formed between the air piston assembly and the rear of the foam dart, and a
(Continued)

second airtight seal is formed between the barrel interface section and the detachable launch barrel.

18 Claims, 6 Drawing Sheets

(51) Int. Cl.
*F41B 11/643* (2013.01)
*F41B 11/646* (2013.01)
*F41B 11/73* (2013.01)

(58) Field of Classification Search
USPC ..... 124/48, 65, 66, 67, 20.3
See application file for complete search history.

(56) References Cited

U.S. PATENT DOCUMENTS

| | | | | | |
|---|---|---|---|---|---|
| 5,522,374 | A * | 6/1996 | Clayton | F41B 11/646 | 124/66 |
| 5,660,159 | A * | 8/1997 | Clayton | F41B 11/646 | 124/66 |
| 5,680,853 | A * | 10/1997 | Clayton | F41B 11/55 | 124/66 |
| 7,537,001 | B2 * | 5/2009 | Ma | F41B 11/73 | 124/69 |
| 8,146,579 | B2 * | 4/2012 | Jablonski | F41B 11/646 | 124/65 |
| 8,336,531 | B2 * | 12/2012 | Fan | F41A 11/02 | 42/75.02 |
| 8,720,426 | B2 * | 5/2014 | Hadley | F42B 12/74 | 124/66 |
| 9,239,206 | B1 * | 1/2016 | Nguyen | F41B 11/646 | |
| 9,347,735 | B2 * | 5/2016 | Falkowski, II | F41B 7/003 | |
| 9,389,042 | B1 * | 7/2016 | Clayton | F41B 11/642 | |
| 9,513,075 | B2 * | 12/2016 | Lallier | F41A 9/73 | |
| 10,859,337 | B1 * | 12/2020 | Bernal | F41B 7/08 | |
| 10,907,929 | B2 * | 2/2021 | Bernal | F41B 4/00 | |
| 11,033,805 | B2 * | 6/2021 | Bernal | F42B 6/06 | |
| 11,243,044 | B2 * | 2/2022 | Chia | F41A 9/66 | |
| 11,353,279 | B2 * | 6/2022 | Chia | F41B 7/006 | |
| 11,519,689 | B2 * | 12/2022 | Chia | F41B 11/54 | |
| 11,644,271 | B1 * | 5/2023 | Huang | F41B 11/89 | 124/56 |
| 12,025,403 | B2 * | 7/2024 | Chia | F41B 7/08 | |
| 12,146,720 | B1 * | 11/2024 | Enderle | F42B 6/003 | |
| 2007/0261689 | A1 * | 11/2007 | Tai | F41B 11/646 | 124/67 |
| 2007/0283941 | A1 * | 12/2007 | Tai | F41B 11/642 | 124/67 |
| 2007/0283942 | A1 * | 12/2007 | Tai | F41B 11/642 | 124/67 |
| 2019/0346231 | A1 * | 11/2019 | Ma | F41A 11/04 | |
| 2021/0095935 | A1 * | 4/2021 | Chia | F41B 11/54 | |
| 2023/0175808 | A1 * | 6/2023 | Chia | F41B 7/08 | 124/16 |
| 2023/0296337 | A1 * | 9/2023 | Chia | F41B 11/89 | 124/71 |
| 2024/0044609 | A1 * | 2/2024 | Chia | F41B 11/89 | |
| 2024/0044610 | A1 * | 2/2024 | Chia | F41C 7/02 | |
| 2024/0151491 | A1 * | 5/2024 | Faecher | F41B 11/89 | |
| 2024/0302128 | A1 * | 9/2024 | Chia | F41B 11/642 | |

FOREIGN PATENT DOCUMENTS

| | | | |
|---|---|---|---|
| CN | 210486666 | U | 5/2020 |
| CN | 212109735 | U | 12/2020 |
| CN | 212133450 | U | 12/2020 |
| EP | 3163246 | A1 | 5/2017 |

OTHER PUBLICATIONS

Written Opinion issued in Application No. PCT/SG2022/050073, dated May 20, 2022.

* cited by examiner

LAUNCHER OF SHORT PROJECTILES WITH DETACHABLE BARREL

REFERENCE TO OTHER APPLICATIONS

This application claims the benefit of and priority to U.S. Provisional Patent Application No. 63/151,853, filed on Feb. 22, 2021, entitled "LAUNCHER OF SHORT PROJECTILES WITH DETACHABLE BARREL," the contents of which are incorporated by reference herein in their entirety.

FIELD

The present invention is generally related to a toy projectile launcher, such as a toy pistol, gun, and the like, for launching toy projectiles, such as foam bullets, darts, balls, and the like, with a simplified construction and improved performance.

BACKGROUND

Traditional toy projectile launchers have utilized various forms of rifles, pistols, blasters, machine guns, and the like, for launching toy projectiles, such as foam balls, darts, to name a few. Such toy launchers have varied in size, power, storage capacity, to name a few. More specifically, toy launchers of foam projectiles-bullets (or "darts"), balls, and the like have become ubiquitous. One standard for foam bullets has been marketed under the brand name Nerf® with a rubber tip and a foam body that totals approximately 71.5 mm in length. Other high-performance darts may be shorter in length. There have been various types of rifles, machine guns, and the like, that have been marketed for launching such foam projectiles.

The caps of the toy darts are generally made of a material other than foam that allows the dart to be shot from the launcher at a targeted person or object and/or propelled over an appropriate distance and/or at a relatively quick speed.

Conventional dart guns have traditionally been marketed to pre-teen children for casual play. More recently, in conjunction with the advent of special event war games—such as paintball, laser tag, and the like—more high-powered launchers have been developed to target enthusiasts for such special events using foam darts.

As an example, launchers having metal barrels, instead of plastic ones, have been used for improved launching velocity. Such launchers and darts are usually dimensioned to have a very small clearance—between the inner diameter of the barrel of the launcher and the outer diameter of the dart—so as to provide improved launching speed and accuracy.

Accordingly, each launcher type has a specific design that accommodates either lower-powered, safer requirements for younger children or more high-powered requirements for older children or adults. This prevents such conventional launchers from being useful across all categories of play.

With the above in mind, there is a need to improve the user adjustability of launchers in terms of safety, launching speed and accuracy.

SUMMARY

To address the above, the present invention is generally related to an improved air-powered toy launcher for launching high performance foam darts. According to an exemplary embodiment of the present disclosure, a toy projectile launcher is equipped to provide a user the ability to transform the launcher between a configuration that complies with safety standards applicable to pre-teen users and a configuration that satisfies the high-power demands of older or professional users. To that end, a launcher may include a detachable launch barrel that forms an airtight seal at the front end of a foam dart so that the dart is launched with a higher launch force, and when the detachable launch barrel is removed or replaced with a slightly larger diameter detachable launch barrel that does not have a front seal, the front seal is eliminated, thereby resulting in a lower power launch force.

In exemplary embodiments, the launcher may include a mechanism for priming a high-performance foam dart from a storage compartment into a firing position in a launch barrel while forming an airtight seal between an air piston nozzle and the launch barrel, thus improving the launch force on the primed dart. For example, co-pending U.S. patent application Ser. No. 16/906,996 and PCT Patent Application No. PCT/SG2021/050248 disclose respective launchers in pistol configurations that include a mechanism for priming darts stored in a storage handle or a cartridge into a firing position in the launch barrel of the pistol launchers. (The contents of U.S. patent application Ser. No. 16/906,996 and PCT Application No. PCT/SG2021/050248 are incorporated herein by reference in their entirety.) In the disclosed launchers, an air piston assembly is movable by a cocking slide in a two-step loading/priming motion, where the air piston assembly retracts-on a pull back on the cocking slide—to allow a top dart in the storage compartment (handle or cartridge) to be lifted to a position in front of the air piston assembly and where the air piston assembly pushes forward—on a push forward on the cocking slide—so that a front air nozzle of the air piston assembly pushes the top dart into the launch barrel and forms an airtight seal with the launch barrel behind the primed dart. It is anticipated that the detachable launch barrel of the present invention can be used with other configurations of air-powered launchers.

In exemplary embodiments, the launcher may include a mechanism to accommodate an air piston nozzle that reaches through a storage drum to prime darts stored in the storage drum and to form an airtight seal with a launch barrel (or launch barrel interface section) in front of the storage drum. For example, co-pending PCT Application No. PCT/SG2021/050250 discloses a resilient mechanism that holds each foam dart in place in a storage area and that allows an air piston nozzle to reach through the storage area (behind the projectile) and to form a sealed connection with the launch barrel, thereby forming a rear seal behind the projectile. (The contents of PCT Application No. PCT/SG2021/050250 are incorporated herein by reference.) Attachment of the detachable barrel creates a front seal for the projectile, and the combination of the back and front seals results in a higher-launch force. Without the detachable barrel, there is no front seal, and thus the projectile fires with less power. Similarly, a low power detachable launch barrel can be used which does not form a front seal and/or has a slightly larger internal diameter to reduce the launch force of the projectile. Such launch barrel may improve accuracy without increasing the velocity of the projectile.

According to an exemplary embodiment, the toy launcher includes a housing, a projectile holder disposed within the housing and configured to contain a plurality of projectiles, a barrel interface section disposed at the front of the housing, an air piston assembly disposed within the housing. According to exemplary embodiments, the air piston assembly includes an air piston barrel having an air nozzle disposed on a front portion thereof, a plunger element, and a compression spring.

According to an exemplary embodiment, the toy launcher includes a cocking slide that is adapted to be moved forward and backward relative to the housing, where the projectile holder and the air piston assembly are coupled to the cocking slide.

According to an exemplary embodiment, the toy launcher includes a first detachable launch barrel that is adapted to (i) engage and attach to the barrel interface section; and (ii) disengage and detach from the barrel interface section.

According to exemplary embodiments, when the cocking slide is moved backward from a forward position to a backward position, the air piston barrel moves backward and pushes the plunger element to compress the compression spring against the rear wall of the housing.

According to exemplary embodiments, when the cocking slide is moved forward from the backward position to the forward position the air piston barrel moves forward, forming an internal air chamber between the front portion of the air piston barrel and the plunger element, and the air nozzle moves forward to form a first airtight seal between the air piston barrel and the barrel interface section.

According to exemplary embodiments, when the first detachable launch barrel is attached to the barrel interface section, a second airtight seal is formed between the air nozzle and the first detachable launch barrel.

According to exemplary embodiments, when the cocking slide is moved backward from a forward position to a backward position, a first projectile contained in the projectile holder is moved to a position in front of the air piston barrel.

According to exemplary embodiments, when the cocking slide is moved forward from the backward position to the forward position, the air nozzle pushes the first projectile into the barrel interface section into a firing position in front of the first airtight seal and behind the second airtight seal.

According to exemplary embodiments, when the first detachable launch barrel is detached from the barrel interface section, no airtight seal is formed in front of the first projectile.

According to exemplary embodiments, the toy launcher further comprises a second detachable launch barrel, where the second detachable launch barrel is adapted to (i) engage and attach to the barrel interface section; and (ii) disengage and detach from the barrel interface section. According to exemplary embodiments, when the second detachable launch barrel is attached to the barrel interface section, no airtight seal is formed between the air nozzle and the second detachable launch barrel when the cocking slide is moved forward from the backward position to the forward position.

According to exemplary embodiments, the toy launcher further comprises a latching assembly coupled between the plunger element and a trigger assembly, wherein the trigger assembly is adapted to be pulled backward by a user of the toy projectile launcher.

According to exemplary embodiments, when the first projectile is in the firing position, the air nozzle is immediately adjacent to the first projectile.

According to exemplary embodiments, the toy launcher is configured as a pistol having a projectile holder disposed within a handle of the housing, In accordance with some of these embodiments, when the cocking slide is moved backward from the forward position to the backward position, the first projectile is lifted from the projectile holder disposed within the handle into the position in front of the air piston assembly.

According to exemplary embodiments, the projectile holder is a rotatable storage drum. In accordance with some of these embodiments, when the cocking slide is moved backward from the forward position to the backward position, the projectile holder rotates to place the first projectile into the position in front of the air piston assembly.

According to exemplary embodiments, the projectile holder includes a plurality of resilient projectile stoppers that each abut a portion of a respective projectile loaded in the projectile holder. In exemplary embodiments, each of the resilient projectile stoppers includes a surface disposed to face and be pushed by the air nozzle when the air piston barrel is pushed forward when the cocking slide is moved from the backward position to the forward position. In exemplary embodiments, each resilient projectile stopper, when pushed by the air nozzle, flexes outward to make way for the air nozzle to extend through the projectile holder.

According to exemplary embodiments, the projectiles are foam darts.

According to an exemplary embodiment, the toy launcher includes a coupling between the cocking slide and the air piston barrel.

According to an exemplary embodiment, the projectile holder includes a projectile advancement mechanism for advancing a next loaded projectile in the projectile holder into a priming position in front of the air piston barrel.

According to an exemplary embodiment, the second detachable launch barrel has a larger inside diameter than the first detachable launch barrel.

According to an exemplary embodiment, the plunger element is pushed forward by the compression spring to expel the air from the internal air chamber through the front air nozzle on the front portion of the air piston barrel behind the next loaded projectile in the firing position when the coupling of the latching assembly between the plunger element and the trigger assembly is released.

BRIEF DESCRIPTION OF THE DRAWINGS

Exemplary embodiments of the present disclosure will be described with references to the accompanying figures, wherein.

DETAILED DESCRIPTION

Figure 7A:
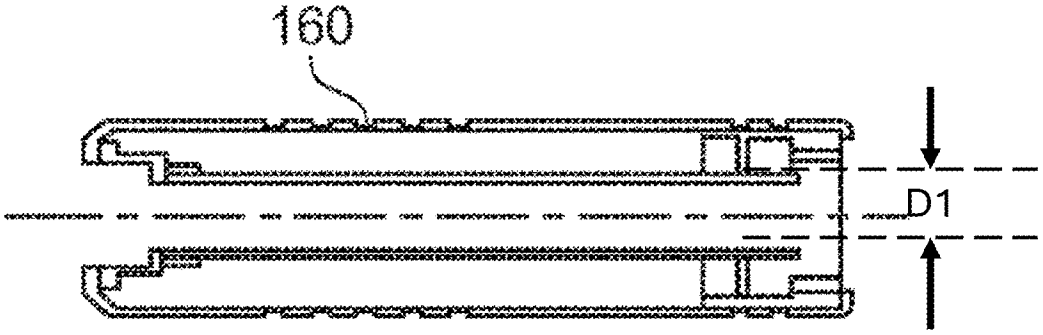
FIG. 7A is a cross sectional side view of a detachable barrel according to an exemplary embodiment of the present invention.
Figure 7B:
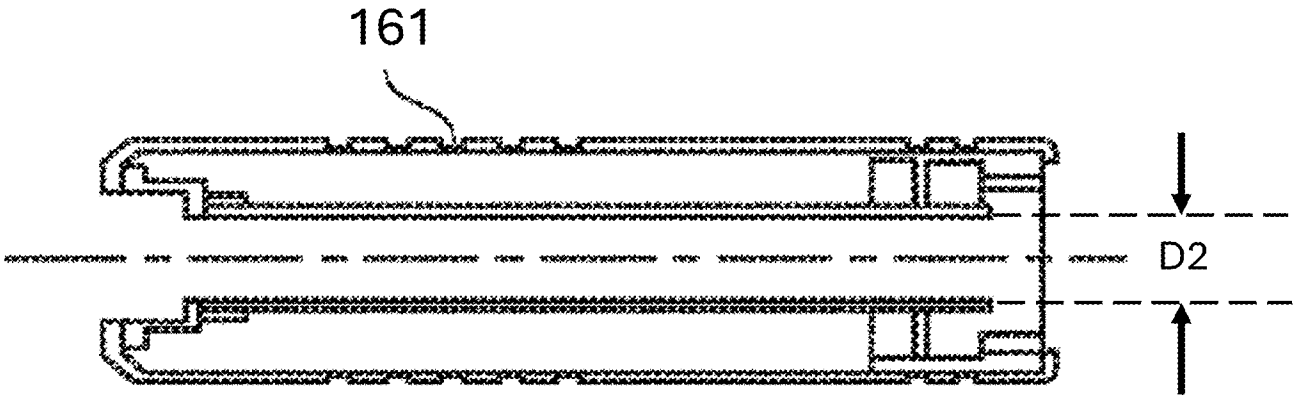
FIG. 7B is a cross sectional side view of a detachable barrel according to an exemplary embodiment of the present invention.

The present invention is generally related to an improved toy launcher that is modifiable by a user so that the launcher may operate with either higher power and more accuracy or lower power and more safety. To achieve this objective, according to an exemplary embodiment, a toy launcher incorporates a detachable launch barrel, so that when the launch barrel is attached it provides an airway seal with the front of the projectile, thereby improving power and accuracy. When the barrel is removed or replaced with another barrel that might be larger in diameter as compared to the high power barrel, the front airway seal is eliminated and the projectile launches at a lower power to address safety concerns. For example, FIG. 7A shows a detachable launch barrel 160 with an internal diameter D1 and FIG. 7B shows a detachable launch barrel 161 with an internal diameter D2 that is larger than the internal diameter D1. The second barrel may provide increased accuracy without requiring increased launch power.

Figure 1A:
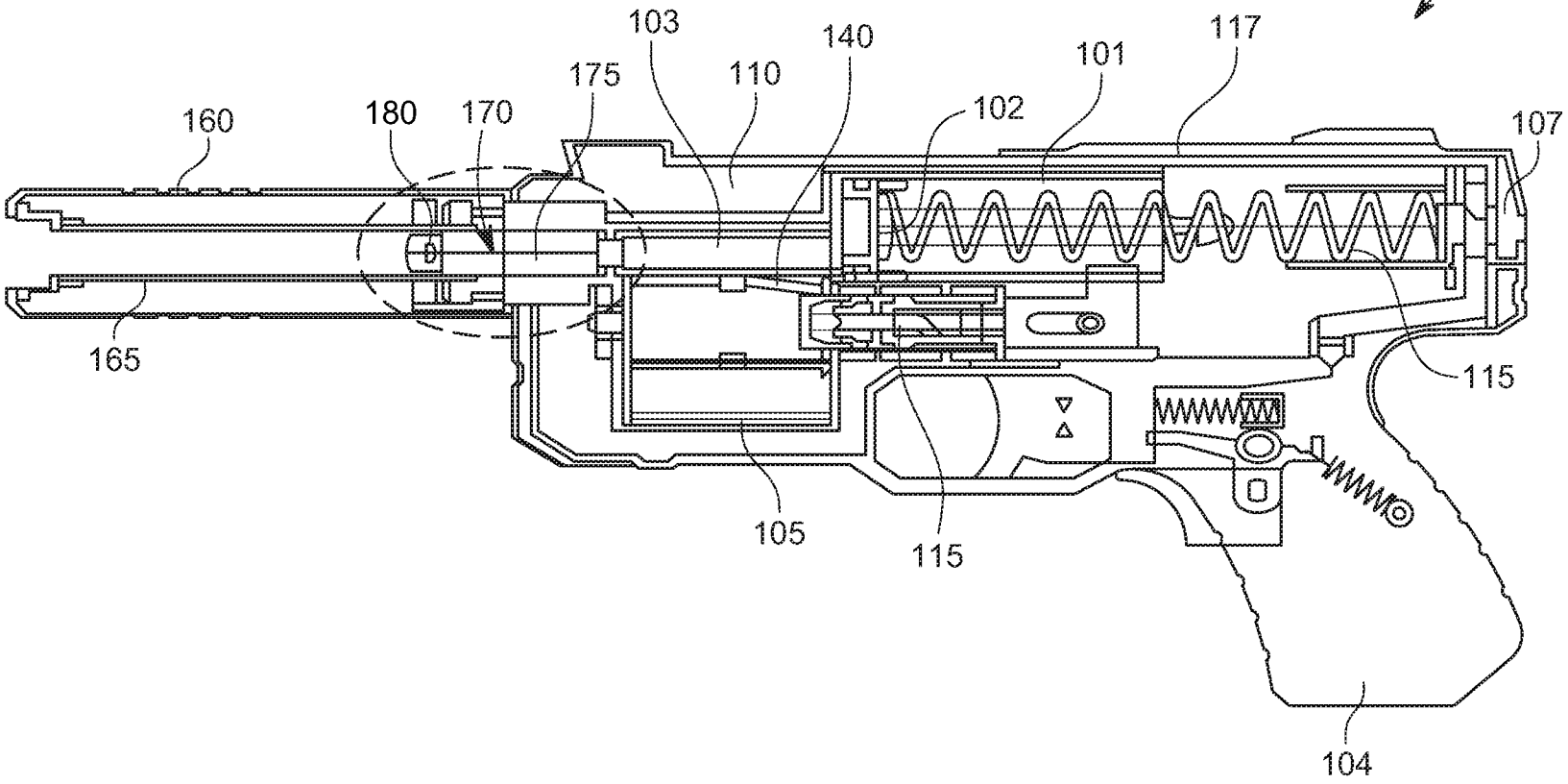
FIG. 1A is a schematic partial cross-sectional side views of key elements of a toy projectile launcher according to an exemplary embodiment of the present disclosure with a detachable launch barrel attached.

FIG. 1A is a schematic partial cross-sectional view of key elements of a toy projectile launcher 100 according to an exemplary embodiment of the present disclosure. For clarity and simplicity in illustrating the key elements and mechanisms of toy projectile launcher 100, portions that are not necessary to understand the scope and the spirit of the present disclosure are not shown. One of ordinary skill in the art would readily understand the supporting elements needed to house and support the various illustrated elements, including those that facilitate the insertion and removal of drum 105 into and out of launcher 100, with various design choices that would not depart from the spirit and scope of the present disclosure.

FIG. 1A is a schematic side cross-sectional view of a projectile launcher 100 in an un-cocked position according to an exemplary embodiment of the present disclosure. As shown in FIG. 1A, projectile launcher 100 is shaped to resemble a pistol. In embodiments, launcher 100 may be in various other shapes and arrangements without departing from the spirit and the scope of the disclosure, such as, for example, a Thompson submachine gun. As illustrated in FIG. 1A, a reciprocating air piston assembly comprised of a barrel 101, a plunger element 102, and a front air nozzle 103 is located above a handle 104 and disposed within a housing 110 of the projectile launcher 100 behind a projectile holding drum 105. According to an exemplary embodiment, barrel 101 of the air piston assembly has a generally rounded cylindrical or an oval cross-sectional shape and plunger element 102 is biased away from a back wall 107 of the rear part of launcher housing 110 by a compression spring 115. The plunger element 102 incorporates a size and a shape that correspond with the cross-sectional shape of barrel 101 so as to form an airtight seal with an internal surface of barrel 101. According to an exemplary embodiment of the present disclosure, plunger element 102 may incorporate a resilient O-ring (made from a resilient material, such as a polymer) (not shown) to form an improved seal.

As shown in FIG. 1A, barrel 101 is coupled to a cocking slide 117 that is fittingly coupled to a track (not shown) incorporated in the housing 110 of launcher 100. As will be described in further detail below, moving the cocking slide 117 back and forth primes the air piston assembly while feeding a foam dart for launch.

As shown in FIG. 1A, the barrel 101 is coupled to the drum 105 by a linear-to-rotational drive mechanism, such as a lead screw and nut arrangement 115, so that linear motion of the barrel 101 (due to movement of the slide 117) results in rotational movement of the drum 105. As will be described in further detail below, drum 105 for holding projectiles-such as foam darts/bullets and the like-would be advanced by the linear motion of the barrel 101 such that a next projectile would be delivered to a firing position. Correspondingly, a spring-loaded stopper block (not shown) may be incorporated in the top portion of housing 110 for holding drum 105 into an aligned position when drum 105 is advanced via the barrel 101. In alternative exemplary embodiments, the barrel 101 need not be coupled to the drum 105, in which case the drum 105 may be rotated manually to deliver a projectile to a firing position.

In embodiments, drum 105 may incorporate attachment elements (not shown) for detachably engaging corresponding elements (not shown) in launcher 100 for a rotatable joint that allows for rotating advancement of the drum 105 by slide 117, with a stopper block (not shown) ensuring an aligned unitary advancement of drum 105 upon each pull on slide 117 by a user.

In the illustrated embodiment, drum 105 is configured to shoot toy darts. Darts may be loaded into drum 105 before drum 105 is loaded into launcher 100 and/or darts may be loaded and/or refilled in drum 105 after drum 105 is loaded into launcher 100. According to an exemplary embodiment, dart, generally designated by reference number 170, has an elongate dart body 175 and a cap 180 that is affixed to the dart body. Dart body 175 has a substantially cylindrical shape and comprises a foam material, or the like, and cap 180 comprises a rubber material, or the like. In embodiments, dart 170 may have a total length, e.g., within a range of approximately 33 mm to 45 mm, such as 35 mm, 36 mm, 37 mm, or 40 mm, to name a few. Alternatively, the dart may have a length of 71.5 mm. although the present invention is described in the context of a foam bullet/dart launcher that utilizes shortened foam bullets/darts. Correspondingly, dart 170 has an outer cross-sectional diameter at its widest point of 12.9 mm. In alternative embodiments, dart 170 may have an outer cross-sectional diameter at its widest point of, for example, 12.5 mm, 13 mm, 14 mm, or 15 mm, to name a few. In embodiments, dart 170 may incorporate one or more recesses and corresponding ridges on its foam body—for example, as disclosed in U.S. patent application Ser. No. 16/895,172 filed on Jun. 8, 2020, the entire contents of which are incorporated by reference herein. Drum 105 is sized according to the darts it will utilize.

Figure 1B:
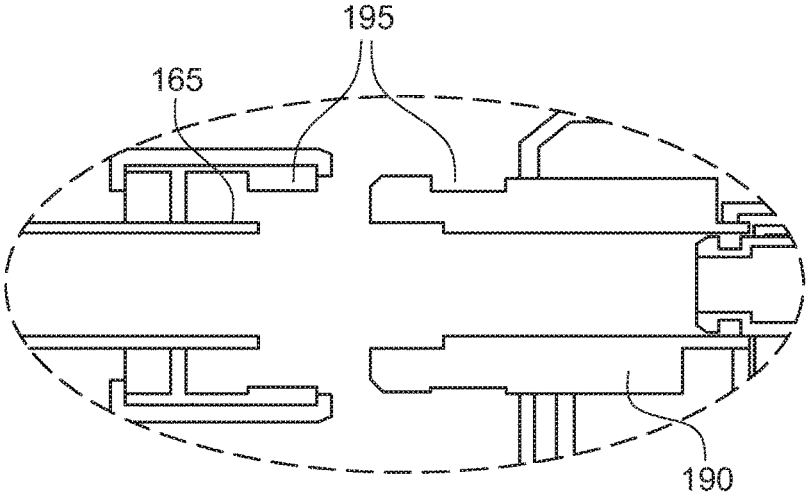
FIG. 1B is a schematic partial cross-sectional side view showing attachment of a detachable launch barrel to the toy projectile launcher according to an exemplary embodiment of the present disclosure.
Figure 1C:
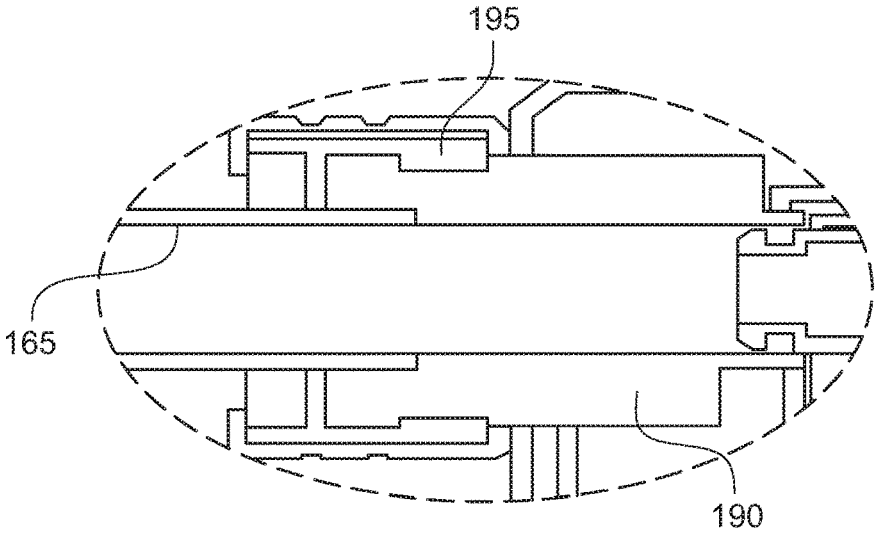
FIG. 1C is a schematic partial cross-sectional side view showing removal of a detachable launch barrel from the toy projectile launcher according to an exemplary embodiment of the present disclosure.

As shown in FIG. 1A and as will be described in further detail below, drum 105 incorporates an S-shaped cantilever stopper spring 140 for each corresponding projectile holder that is flexible downward to allow nozzle 103 of the air piston assembly to extend through drum 105 to form a seal with a firing tube 165 formed within a detachable launch barrel 160. Removal of the launch barrel 160 (and the corresponding firing tube 165) removes the seal between the nozzle 103 and the firing tube 165 so that the projectile is launched with lower power. In exemplary embodiments, as shown in FIGS. 1B and 1C, the launch barrel 160 may be removable attached to a barrel interface section 190 disposed at the front of the launcher 100 by a locking mechanism 195. Although the locking mechanism 195 is shown in the figures as a twist-and-lock mechanism, it should be appreciated that the locking mechanism is not limited by this, and in other exemplary embodiments may be a screw mechanism, a plug-in attachment, or any other arrangement that allows for removable attachment of the launch barrel 160 to the barrel interface section 190.

According to an exemplary embodiment, spring 140 is composed of a resilient thermoplastic material. In embodiments, other suitable resilient materials may be used for providing the flexibility to spring 140 needed to flex away from dart holders 205 (FIG. 1D) when nozzle 103 is extended through drum 105, as shown in FIG. 1, and to return to an original configuration to serve as a back stop (or stopper) for darts 170 held in dart holders 205 (FIG. 4) in drum 105. Conventional drums utilize rigid retaining walls at the rear of the drum to retain darts within the drum. When the drums have openings to allow darts to be pushed forward for launching, such openings necessarily have a smaller cross-sectional area than the dart holders of such drums. In an embodiment of the present disclosure, since spring 140 is movable out of dart holder 205 when nozzle 103 moves through dart holder 205, the diameter of air nozzle 103 can be maximized.

As illustrated in FIGS. 1B and 1C, barrel interface section 190 is fixed to housing 110 and includes a rear opening for receiving nozzle 103 and an opposite front opening that connects to launch barrel 160. As will be described in further detail below, when the launch barrel 160 is fitted to the launcher 100, barrel interface section 190 forms an airtight connection between air piston nozzle 103 and launch barrel 160 and provides for receiving a primed projectile, such as foam dart 170, into a primed position for launch. Accordingly, a user may pull back cocking slide 117 to move the air piston assembly—i.e., barrel 101, plunger element 102, and nozzle 103—backward and to advance drum 105 in a first, pull-back, priming step and the user may then push cocking slide 117 forward, in a second priming step, to push barrel 101 and nozzle 103 forward. As will be described in detail below and shown in FIGS. 2-6, a dart 170 held in drum 105 is pushed forward into barrel interface section 190 (and partially into the firing tube 165 of the launch barrel 160) by nozzle 103 and into a launch position in front of nozzle 103, which forms an airtight seal with launch barrel 160 behind dart 170 since the outside diameter of the air nozzle 103 is essentially the same as the inside diameter of the dart holder 205 and the inside diameter of launch barrel 160.

Figure 1D:
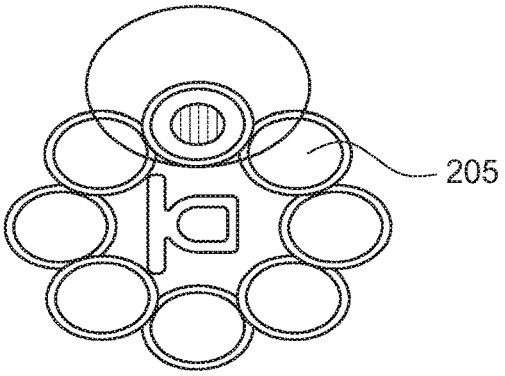
FIG. 1D is a schematic partial cross-sectional front view of a projectile storage drum useable with the toy projectile launcher of FIG. 1A according to an exemplary embodiment of the present disclosure.

FIG. 1D is a schematic partial cross-sectional front view of drum 105 shown in FIG. 1A according to an exemplary embodiment of the present disclosure. As shown in FIG. 1D, drum 105 includes integrated dart holders 205 around its outer circumference, each dimensioned to accommodate a foam dart 170 for use with launcher 100 and through which nozzle 103 is extended to connect to barrel interface section 190 in the arrangement shown in FIG. 1A. A drum incorporating a different number of dart holders 205 and/or a different number of rows of dart holders 205 as that show in FIG. 1D may be used without departing from the spirit and the scope of the present disclosure. An example of a drum incorporating plural rows of darts is disclose in co-pending U.S. patent application Ser. No. 17/038,106. (The contents of U.S. patent application Ser. No. 17/038,106 are incorporated herein by reference.)

Operation of the toy launcher will now be described with reference to FIGS. 2-6. In each of FIGS. 2-6 toy launcher 100 is shown with launch barrel 160 removed.

Figure 2:
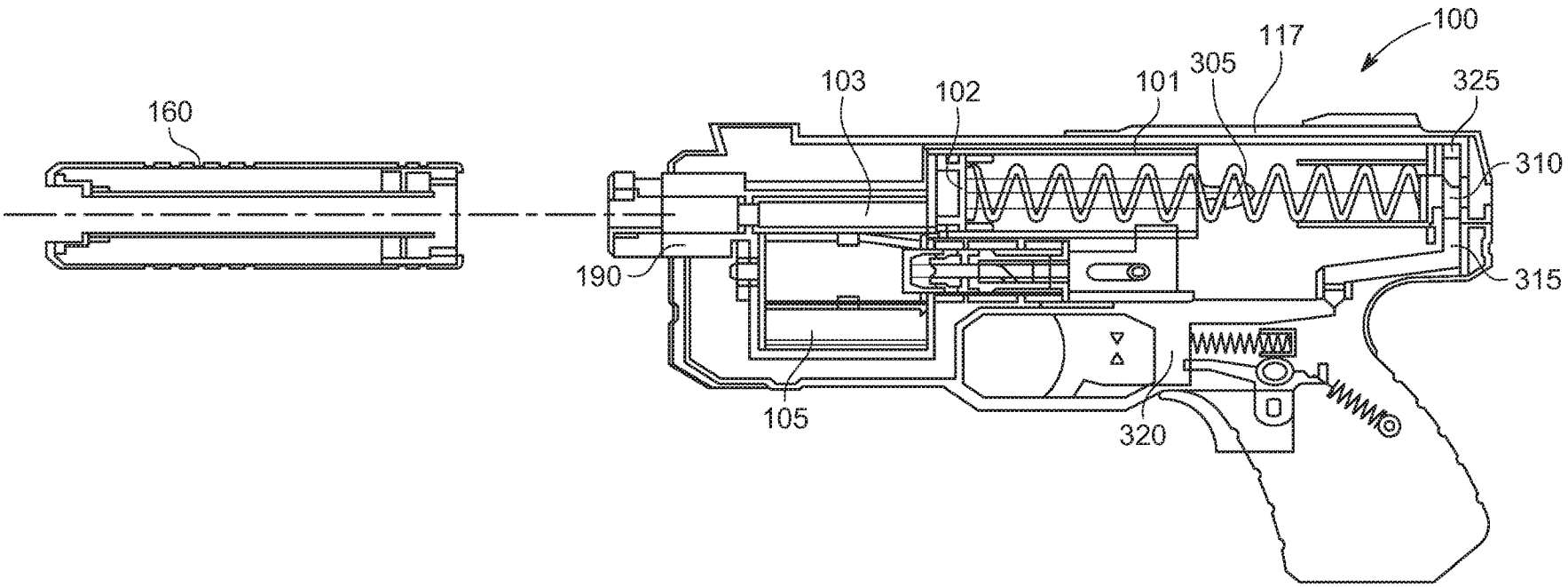
FIG. 2 is a schematic partial cross-sectional side view of the toy projectile launcher of FIG. 1A according to an exemplary embodiment of the present disclosure with a detachable launch barrel removed.
Figure 3:
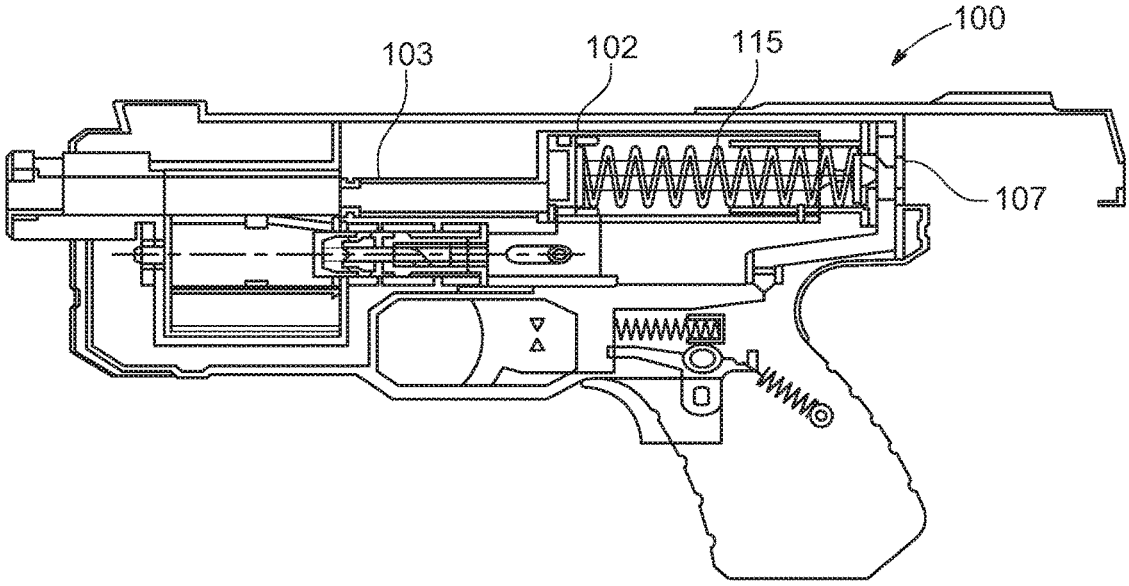
FIG. 3 is a schematic partial cross-sectional side view of the toy projectile launcher of FIG. 2 with a cocking slide being placed in a rearward loading and priming (cocked) position according to an exemplary embodiment of the present disclosure.
Figure 4:
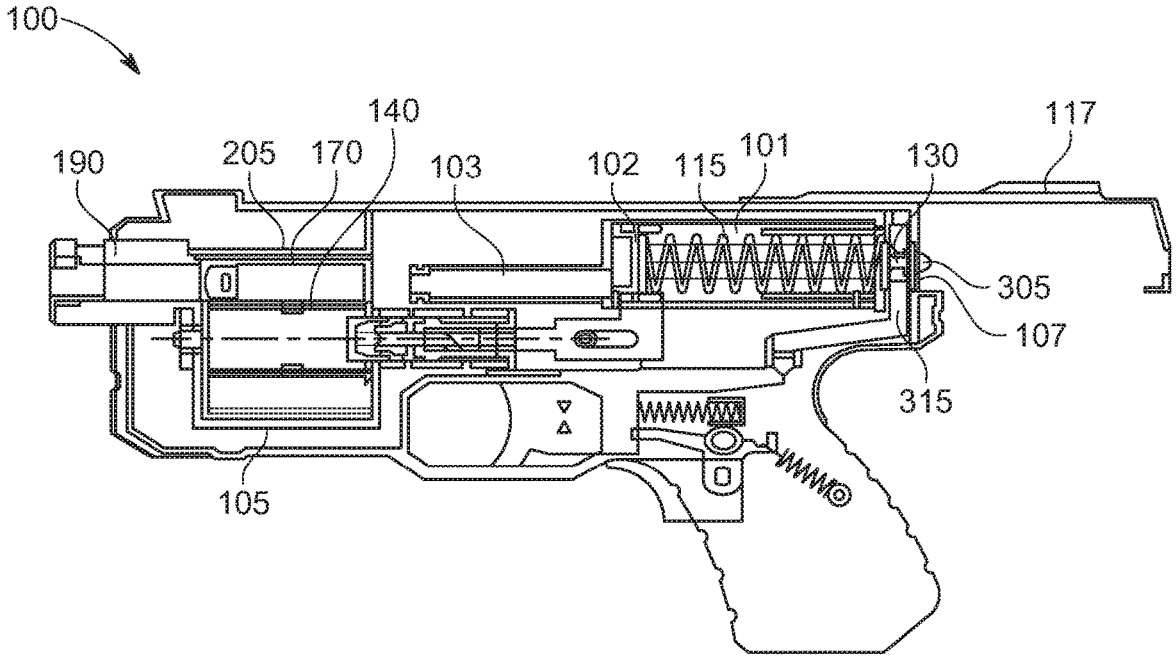
FIG. 4 is a schematic partial cross-sectional side view of the toy projectile launcher of FIG. 2 with a cocking slide placed in a rearward loading and priming (cocked) position according to an exemplary embodiment of the present disclosure.

In FIG. 2, the toy launcher 100 is at rest with the nozzle 103 inserted through the drum 105. FIGS. 3-4 show the toy launcher proceeding from the configuration shown in FIG. 2 to a first, pull back, priming step. Specifically, as previously mentioned, toy launcher 100 includes barrel 101 with a plunger element 102 that form an air piston assembly. Barrel 101 is coupled to the cocking slide 117 so that a user may pull back barrel 101 and plunger element 102 as part of the first, pull-back, priming step. As shown in FIGS. 3 and 4, spring 115 is compressed between plunger element 102 and back wall 107. Advantageously, plunger element 102 starts at a position near a front portion of barrel 101, as shown in FIG. 1, and, therefore, compression spring 115 may be fully compressed in the position illustrated in FIG. 4.

According to an exemplary embodiment of the present disclosure, back wall 107 includes an aperture that allows a dome-shaped rod portion 305 (FIG. 4) to extend through and past another aperture 310 (FIG. 2) that is incorporated in a spring-loaded plate 315 that is, in turn, coupled to a trigger assembly 320. When a user pulls cocking slide 117 backward, barrel 101, plunger 102, and rod portion 305 are pushed back as well. Plate 315 is coupled to a compression spring 325 that biases plate 315 downward towards the trigger assembly 320. According to an exemplary embodiment of the disclosure, the leading edge of dome-shaped rod portion 305 is rounded and when it is pushed backward, the rounded leading sloped edge pushes upward on a top edge of aperture 310 in plate 315, compressing spring 325, so that rod portion 305 can be pushed through aperture 310 from the front of plate 315 to clear an opposing back side of plate 315. Once rod portion 305 is pushed sufficiently past plate 315 through aperture 310, spring 325 moves plate 315 downward into engagement with a notch or recess 330 (FIG. 4) opposite the rounded face of rod portion 305 so that rod portion 305—and, correspondingly, plunger element 102—is engaged with, and temporarily retained in place by plate 315. As shown in FIG. 4, the notch 330 hooks to the opposing back side of plate 315 above aperture 310 once plate 315 is pushed downwardly by compression spring 325 into notch 330 and, accordingly, a top edge of aperture 310 is pushed into a bottom surface of notch 330. Thus, plate 315, compression spring 325, and notch 330 together form a latching assembly for holding rod portion 305 in the backward position with compression spring 115 fully compressed.

In alternative embodiments, a structural stop (not shown) may be used to limit the backward motion of cocking slide 117 to the above full extension position—i.e., the engagement position between notch 330 and plate 315.

Correspondingly, with barrel 101 and cocking slide 117 moved back to the configuration shown in FIG. 4, nozzle 103 is pulled back away from barrel interface section 190 and from one of the dart holders 205 in drum 105 through a rear opening of dart holder 205, thus clearing the way on the rear end for drum 105 to rotate.

In substantial synchronization with nozzle 103 being retracted from dart holder 205 of drum 105, drum 105 is rotated to advance to a next dart holder 205. As discussed above, according to an exemplary embodiment, the linear motion of the barrel 101 is translated into rotational motion imparted to the drum 105 through operation of a linear-to-rotational drive mechanism.

FIG. 4 shows an individual dart holder 205 holding a dart 170 after drum 105 has been rotated upon a pull back on cocking slide 117. In exemplary embodiments, each dart holder includes a main central portion, which is formed in the shape of a cylinder with a cross-sectional diameter of about 13 mm for fitting and holding the widest point(s) of the foam body of dart 170. Each holder 205 includes an inner rear end opening for spring 140 to extend inward so that a hook element thereof forms a front facing flat surface stop to stop the rear end of dart 170 and thereby holding dart 170 in the main central portion of dart holder 205 and preventing movement of the dart 170 through the rear of the drum during loading. Each hook element serves to abut the rear end of each corresponding dart that is loaded into drum 105 by insertion though a front end of each dart holder 205. According to an exemplary embodiment, launch barrel 160 and barrel interface section 190 each have an inner diameter of approximately 13.26 mm to provide minimal clearance for dart 170, which each has an outer diameter of approximately 13 mm. According to an exemplary embodiment, main portion, including hook portion, has an interior diameter of about 12.9 mm and may be tapered slightly from hook element to front end—in other words, having a slightly larger interior circumference towards front end—to allow for inserting each dart 170 from front end to abut front facing surface of hook element and for holding each dart 170 in place. As an example, the interior diameter of main portion near front end is slightly more than 12.9 mm and the interior diameter of main portion near hook element is slightly less than 12.9 mm. The dimensions provided herein are merely exemplary and not intended to limit the invention in anyway.

Figure 5:
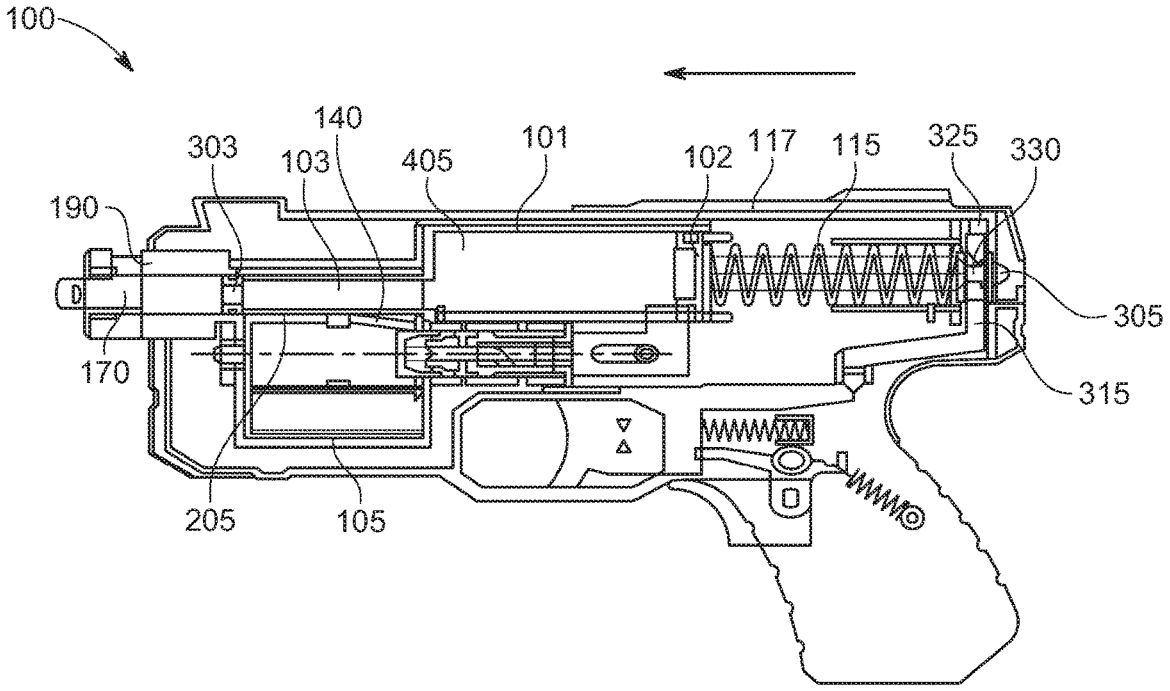
FIG. 5 is a schematic partial cross-sectional side view of the toy projectile launcher of FIG. 4 the cocking slide being returned to a forward firing position according to an exemplary embodiment of the present disclosure.

Referring now to FIG. 5, with the notch/recess 330 of rod portion 305 engaged with plate 315 via the downward bias of spring 325, the user can push cocking slide 117 forward in a second priming step-see forward arrow adjacent cocking slide 117 in FIG. 5. Consequently, barrel 101 is pulled forward towards the front of launcher 100 while rod portion 305 and plunger element 102 are held in place by plate 315. As shown in FIG. 5, compression spring 115 remains fully compressed by the return of cocking slide 117 to its original forward position. Accordingly, plunger element 102 forms an air chamber 405 within barrel 101 whereby air is drawn in through nozzle 103 of barrel 101. In accordance with an exemplary embodiment of the present disclosure, barrel 101 incorporates a resilient element (not shown) on a rear internal surface thereof to further improve the seal for air chamber 405 and to provide cushioning between the front surface of plunger element 102 and the rear internal surface of barrel 101. Nozzle 103 may be of a substantially smaller diameter than that of the air chamber 405 so that a forward push by plunger 102 would expel the air through nozzle 103 at a higher pressure.

As further shown in FIG. 5, as the cocking slide 117 is moved forward in the direction shown by the forward arrow, a dart 170 is pushed forward from drum 105 into barrel interface section 190 (and, as shown in FIG. 1A, when the launch barrel 160 is installed on the launcher 100, partially into the firing tube 165) by nozzle 103, now inserted back into the rear opening of barrel interface section 190 through dart holder 205. The front portion of the nozzle 103 pressed into contact with the back portion of the dart 170 results in a rear airtight seal. When the launch barrel 160 is installed on the launcher 100 before the priming steps, a front airtight seal is also formed between the dart 170 and the firing tube 165. The combination of the front and back seals provides the dart 170 with a higher velocity flight as compared to that achieved without the launch barrel 160 installed.

As further shown in FIG. 5, upon insertion of the nozzle 103 into the dart holder 205, the corresponding spring element 140 is flexed downward to make way for the nozzle 103. As spring element 140 is moved completely out of the dart holder 205, nozzle 103 can have nearly the same outside diameter as the inside diameter of the dart holder 205 thereby maximizing the diameter of the nozzle 103, in contrast to smaller nozzles for fitting through conventional drums having a reduced diameter due to the use of rigid retaining walls at the rear of a drum.

In an exemplary embodiment, nozzle 103 incorporates an O-ring 303 around its outer circumference to form a seal around the internal circumference of the rear opening of barrel interface section 190. Advantageously, the rear airtight seal is formed from air chamber 405 directly through nozzle 103 to the rear end of dart 170, now placed in the firing position in barrel interface section 190, without the need for any connections involving dart holder 205 and, thus, further improving the airtight connection. Additionally, spring 140 allows for nozzle 103 to be larger in cross section—for example, having an outer diameter of slightly less than 12.9 mm to fit through main portion 220 of each dart holder 205—so that the rear airtight seal can be formed with barrel interface section 190 while having an air exit for nozzle 103 that substantially overlaps the rear end of dart 170, thus improving the launch force on dart 170.

Figure 6:
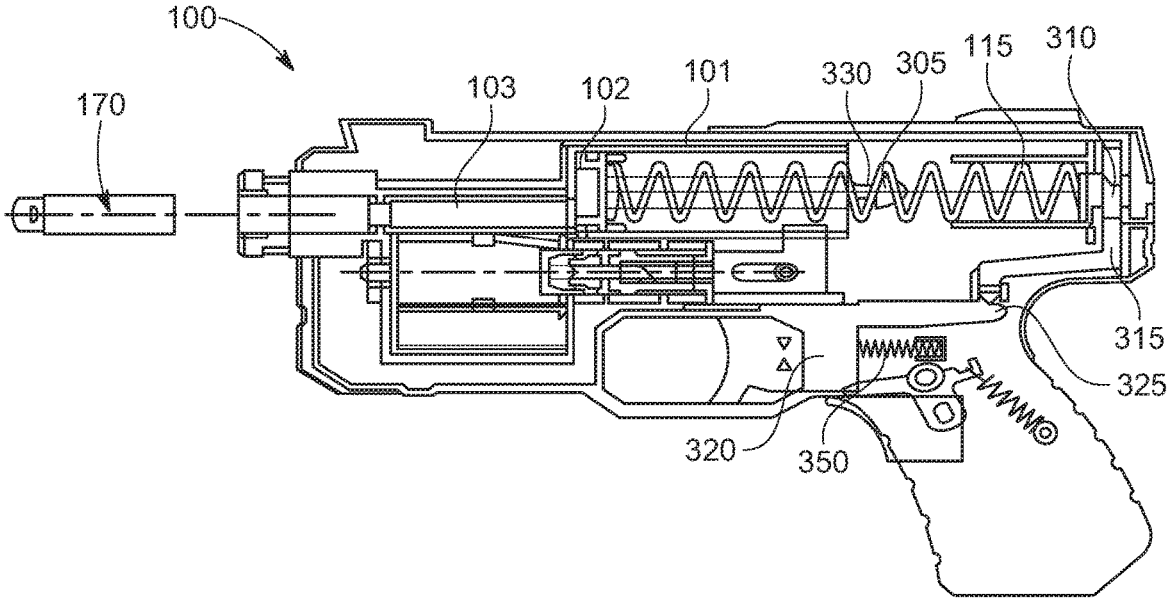
FIG. 6 is a schematic partial cross-sectional side view of the toy projectile launcher of FIG. 5 after a trigger pull illustrating the launch of a foam dart.

FIG. 6 shows a trigger pull resulting in the launch of dart 170 from the launcher 100. In this regard, in accordance with an exemplary embodiment, the trigger assembly 320 includes a camming surface 325. When the trigger assembly 320 is pulled backward by the user, locking plate 315 is caused to move upward by the camming surface 325. In embodiments, trigger assembly 320 may be biased forward in a default position by a spring 350, or the like, such that plate 315 returns to its downward position when the trigger assembly 315 is in the forward, default, non-firing position. As plate 315 is pushed upward by the camming surface 325 of trigger assembly 320, the engagement between plate 315 and notch/recess 330 of rod portion 305 is released as aperture 310 is moved upward to a position that clears notch/recess 330. Thus, as illustrated in FIG. 6, spring 115 is released from its fully compressed state thereby driving plunger element 102 forcefully forward until the front surface of plunger element 102 abuts the rear internal surface of barrel 101 to thereby expel the collected air from air chamber 405 through nozzle 103 to launch dart 170. If the launch barrel 160 is not installed, the dart 170 is fired directly from the barrel interface section 190, with just a rear airtight seal (between the nozzle 103 and the dart 170) providing the launch force. With the launch barrel 160 installed, the dart 170 is fired through the launch barrel 170, with the front airtight seal (between the dart 170 and the firing tube 165) providing a front airtight seal in addition to the back airtight real already provided between the nozzle 103 and dart 170, thereby launching the dart 170 with higher velocity and accuracy as compared to that provided by the launcher 100 without the launch barrel 160.

After release of the trigger, trigger assembly 320 is returned to the forward default position and plate 315 is returned to its lowered position. According to an exemplary embodiment of the present disclosure, cocking slide 117 may be pulled backward again to the position shown in FIG. 4 to prime a next dart 170 in drum 105 and into the firing position shown in FIG. 5 by a push forward again on cocking slide 117.

Although the exemplary embodiment is described in the context of a foam bullet/dart launcher that utilizes shortened foam bullets/darts, it is to be understood that the two-step priming/loading and firing action according to the present disclosure could be applied to a toy projectile launcher of other types of projectiles (e.g., a ball or the like) or a fluid launcher whereby the fluid from a reservoir in the handle is driven by a plunger. In such environment the two-step priming/pumping action of the present disclosure enables a handheld high-velocity fluid burst launcher.

While particular embodiments of the present disclosure have been shown and described in detail, it would be obvious to those skilled in the art that various modifications and improvements thereon may be made without departing from the spirit and scope of the disclosure. It is therefore intended to cover all such modifications and improvements that are within the scope of this disclosure.

What is claimed is:

1. A toy projectile launcher, comprising:

a housing;

a projectile holder disposed within the housing and configured to contain a plurality of projectiles;

a barrel interface section disposed at a front portion of the housing;

an air piston assembly disposed within the housing and including an air piston barrel having an air nozzle disposed on a front portion thereof, a plunger element, and a compression spring;

a cocking slide that is adapted to be moved forward and backward relative to the housing, the projectile holder and the air piston assembly being coupled to the cocking slide; and a first detachable launch barrel that is adapted to (i) engage and attach to the barrel interface section; and (ii) disengage and detach from the barrel interface section;

wherein, when the cocking slide is moved backward from a forward position to a backward position, the air piston barrel moves backward and pushes the plunger element to compress the compression spring against a rear wall of the housing;

wherein, when the cocking slide is moved forward from the backward position to the forward position:

the air piston barrel moves forward, forming an internal air chamber between a front portion of the air piston barrel and the plunger element; and the air nozzle moves forward to push one of the plurality of projectiles from the projectile holder into the barrel interface section to form a first airtight seal between the air piston barrel and the barrel interface section; and wherein, when the first detachable launch barrel is attached to the barrel interface section, a second airtight seal is formed between the air nozzle and the first detachable launch barrel.

2. The toy projectile launcher of claim 1, wherein, when the cocking slide is moved backward from a forward position to a backward position, a first projectile contained in the projectile holder is moved to a position in front of the air piston barrel.

3. The toy projectile launcher of claim 2, wherein the projectile holder includes a projectile advancement mechanism for advancing the first projectile contained in the projectile holder into the position in front of the air piston barrel.

4. The toy projectile launcher of claim 2, wherein, when the cocking slide is moved forward from the backward position to the forward position, the air nozzle pushes the first projectile into the barrel interface section into a firing position in front of the first airtight seal and behind the second airtight seal.

5. The toy projectile launcher of claim 4, wherein, when the first detachable launch barrel is detached from the barrel interface section, no airtight seal is formed in front of the first projectile.

6. The toy projectile launcher of claim 4, further comprising a latching assembly coupled between the plunger element and a trigger assembly, wherein the trigger assembly is adapted to be pulled backward by a user of the toy projectile launcher.

7. The toy projectile launcher of claim 6, wherein the plunger element is pushed forward by the compression spring to expel air from the internal air chamber through the air nozzle behind the first projectile in the firing position when the coupling of the latching assembly between the plunger element and the trigger assembly is released.

8. The toy projectile launcher of claim 4, wherein, when the first projectile is in the firing position, the air nozzle is immediately adjacent to the first projectile.

9. The toy projectile launcher of claim 4, wherein the housing is configured as a pistol, and wherein the projectile holder is disposed within a handle of the housing.

10. The toy projectile launcher of claim 9, wherein, when the cocking slide is moved backward from the forward position to the backward position, the first projectile is lifted from the projectile holder disposed within the handle into the position in front of the air piston assembly.

11. The toy projectile launcher of claim 4, wherein the projectile holder is a rotatable storage drum, and wherein, when the cocking slide is moved backward from the forward position to the backward position, the projectile holder rotates to place the first projectile into the position in front of the air piston assembly.

12. The toy projectile launcher of claim 11, wherein the projectile holder includes a plurality of resilient projectile stoppers that each abut a portion of a respective projectile loaded in the projectile holder.

13. The toy projectile launcher of claim 12, wherein each of the resilient projectile stoppers includes a surface disposed to face and be pushed by the air nozzle when the air piston barrel is pushed forward when the cocking slide is moved from the backward position to the forward position.

14. The toy projectile launcher of claim 13, wherein each resilient projectile stopper, when pushed by the air nozzle, flexes outward to make way for the air nozzle to extend through the projectile holder.

15. The toy projectile launcher of claim 1, further comprising a second detachable launch barrel, wherein the second detachable launch barrel is adapted to (i) engage and attach to the barrel interface section; and (ii) disengage and detach from the barrel interface section; and wherein, when the second detachable launch barrel is attached to the barrel interface section, no airtight seal is formed between the air nozzle and the second detachable launch barrel when the cocking slide is moved forward from the backward position to the forward position.

16. The toy projectile launcher of claim 15, wherein the first detachable launch barrel has a first inside diameter and the second detachable launch barrel has a second inside diameter, and wherein the first inside diameter is less than the second inside diameter.

17. The toy projectile launcher of claim 1, wherein the projectiles are foam darts.

18. A toy projectile launcher, comprising:

a housing;

a projectile holder disposed within the housing and configured to contain a plurality of projectiles;

a barrel interface section disposed at a front portion of the housing;

an air piston assembly disposed within the housing and including an air piston barrel having an air nozzle disposed on a front portion thereof, a plunger element, and a compression spring;

a cocking slide that is adapted to be moved forward and backward relative to the housing, the projectile holder and the air piston assembly being coupled to the cocking slide;

a latching assembly coupled between the plunger element and a trigger assembly, wherein the trigger assembly is adapted to be pulled backward by a user of the toy projectile launcher; and a first detachable launch barrel that is adapted to (i) engage and attach to the barrel interface section; and (ii) disengage and detach from the barrel interface section;

wherein, when the cocking slide is moved backward from a forward position to a backward position:

the air piston barrel moves backward and pushes the plunger element to compress the compression spring against a rear wall of the housing; and a first projectile contained in the projectile holder is moved to a position in front of the air piston barrel;

wherein, when the cocking slide is moved forward from the backward position to the forward position:

the air piston barrel moves forward, forming an internal air chamber between a front portion of the air piston barrel and the plunger element; and the air nozzle moves forward to push one of the plurality of projectiles from the projectile holder into the barrel interface section to form a first airtight seal between the air piston barrel and the barrel interface section with the first projectile disposed between the air piston barrel and the barrel interface section;

wherein, when the first detachable launch barrel is attached to the barrel interface section:

a second airtight seal is formed between a front portion of the first projectile and the first detachable launch barrel; and the air nozzle pushes the first projectile into the barrel interface section into firing position in front of the first airtight seal and behind the second airtight seal; and wherein the plunger element is pushed forward by the compression spring to expel air from the internal air chamber through the air nozzle behind the first projectile in the firing position when the coupling of the latching assembly between the plunger element and the trigger assembly is released.

* * * * *